US010934044B2

(12) United States Patent
Ayers et al.

(10) Patent No.: US 10,934,044 B2
(45) Date of Patent: Mar. 2, 2021

(54) TOOLS FOR RELEASING CABLE TIES

(71) Applicant: THE BOEING COMPANY, Chicago, IL (US)

(72) Inventors: Aaron Robert Ayers, Granite Falls, WA (US); Christine Mary Anderson, Edmonds, WA (US); David Scott Wright, Snohomish, WA (US); Donald Wayne Coffland, Seattle, WA (US)

(73) Assignee: THE BOEING COMPANY, CHICAGO ( * ) Notice: Subject to any disclaimer, the term of this patent is extended or adjusted under 35 U.S.C. 154(b) by 307 days.

(21) Appl. No.: 15/476,495

(22) Filed: Mar. 31, 2017

(65) Prior Publication Data

US 2018/0281161 A1 Oct. 4, 2018

(51) Int. Cl.
*B65B 69/00* (2006.01)
*B65B 13/02* (2006.01)

(52) U.S. Cl.
CPC ..... *B65B 69/0025* (2013.01); *B65B 13/027* (2013.01)

(58) Field of Classification Search
CPC ..... B23P 11/005; B23P 11/00; B23P 19/04; B23P 19/00; B25C 3/00; B25B 27/14; B25B 27/146
USPC ..... 269/3, 6, 95; 29/243.521, 243.58, 278, 29/255; 81/312, 9.3, 9.43
See application file for complete search history.

(56) References Cited

U.S. PATENT DOCUMENTS 3,168,119 A 2/1965 Schwester et al.
3,212,315 A * 10/1965 Lee ..... H01R 43/042 72/407
3,492,854 A * 2/1970 Eppler ..... H01R 43/042 140/113
3,584,525 A * 6/1971 Caveney ..... B65B 13/027 81/488
3,603,497 A * 9/1971 Nishikawa ..... A01G 17/085 227/76
3,926,195 A * 12/1975 Bleier ..... A61B 17/076 128/831

(Continued)

OTHER PUBLICATIONS

Panduit, Model GS4H, http://www.panduit.com/wcs/Satellite?c=Page&childpagename=Panduit_Global%2FPG_Layout&cid=1345565612156&locale=en_us&pagename=PG_Wrapper&item_id=GS4H, Jul. 31, 2015, 1 page, Panduit.

*Primary Examiner* — Lee D Wilson
*Assistant Examiner* — Thomas Raymond Rodgers
(74) *Attorney, Agent, or Firm* — The Small Patent Law Group LLC; Joseph M. Butscher

(57) ABSTRACT

A tool comprises housing, elongated member, trigger, first jaw, and second jaw. Housing comprises housing abutment surface. Elongated member comprises distal end, proximal end, and elongated-member abutment surface. Trigger is pivotally coupled to housing and is coupled to elongated member. Elongated member translates along axis when trigger is moved relative to housing. First jaw abuts housing abutment surface of housing and is configured to engage cable tie. First jaw is located between distal end of elongated member and housing abutment surface. Second jaw abuts elongated-member abutment surface and is configured to engage cable tie. Second jaw translates relative to first jaw along axis when trigger is pivoted with respect to housing.

20 Claims, 7 Drawing Sheets

(56) References Cited

U.S. PATENT DOCUMENTS 4,188,023 A * 2/1980 Whaley ..... B25B 13/18 269/228
4,335,477 A * 6/1982 Halstead ..... B25B 25/005 7/158
4,395,928 A * 8/1983 Undin ..... H02G 1/1212 81/9.43
4,410,019 A * 10/1983 Suzuki ..... B65B 13/027 140/123.6
4,440,170 A * 4/1984 Golden ..... A61B 17/128 606/142
4,459,717 A 7/1984 Halstead
4,602,418 A * 7/1986 Bone ..... B25B 25/005 140/123.6
4,696,327 A * 9/1987 Wolcott ..... B65B 13/027 140/150
5,009,134 A * 4/1991 Sorensen ..... B25B 5/067 81/487
5,309,802 A 5/1994 Mammosser
5,355,913 A * 10/1994 Green ..... A61B 17/823 140/123.6
5,769,133 A * 6/1998 Dyer ..... B65B 13/027 140/123.6
5,915,425 A * 6/1999 Nilsson ..... B65B 13/027 140/123.6
6,079,296 A * 6/2000 Muromoto ..... H02G 1/1212 81/9.43
6,276,059 B1 8/2001 Kan
6,629,443 B2 * 10/2003 Chin ..... B25B 7/12 29/751
7,043,826 B2 * 5/2006 Naito ..... B21J 15/025 29/252
7,444,744 B2 * 11/2008 Caveney ..... H01R 43/0421 29/566.4
7,905,698 B2 * 3/2011 Liu ..... B25B 13/08 411/388
8,104,180 B2 * 1/2012 Swinford ..... B25B 7/02 132/73.5
9,032,598 B2 * 5/2015 Eldar ..... B25B 27/10 269/3
10,112,547 B2 * 10/2018 Detweiler ..... B60R 9/10
2005/0005993 A1 * 1/2005 Magno, Jr. ..... B65B 13/027 140/123.6
2005/0235778 A1 * 10/2005 Murphy ..... H02G 1/1212 81/9.43
2005/0268983 A1 * 12/2005 Levin ..... B65B 13/027 140/123.6
2007/0267085 A1 * 11/2007 Bae ..... B65B 13/027 140/93.2
2007/0277383 A1 * 12/2007 Tomasetti ..... B26B 17/00 30/286
2009/0064823 A1 * 3/2009 Huang ..... B25B 25/005 81/9.3
2010/0206148 A1 8/2010 Reyes
2011/0265332 A1 11/2011 Cornell et al.
2013/0139392 A1 6/2013 Wright et al.
2015/0343609 A1 * 12/2015 Coffland ..... B25B 7/04 81/418
2017/0028573 A1 * 2/2017 Offerman ..... B26B 13/06
2019/0127095 A1 * 5/2019 Kitago ..... B65B 13/18

* cited by examiner

TOOLS FOR RELEASING CABLE TIES

TECHNICAL FIELD

The present disclosure relates to apparatuses and methods for removing cable ties.

BACKGROUND

Cable ties may be used to secure at least one cable or wire in place. The cable tie includes a head with a pawl that is configured to engage a strap having teeth.

Removal of the installed cable tie, however, may be problematic. Conventionally, the cable tie may be removed by one or more techniques. For example, a sharp object, such as a razor blade or a knife, may be used to cut through the strap to release the cable tie. However, the sharp object may damage cables or other equipment retained by the cable tie and may present a safety risk for operators. Another conventional approach is to use a tool that cuts or otherwise damages the pawl of the cable tie, causing the pawl or a portion thereof to disengage from the strap. Accordingly, damaging the pawl may produce FOD (foreign-object debris), which is undesirable, for example, in aircraft applications.

SUMMARY

Accordingly, apparatuses and methods, intended to address at least the above-identified concerns, would find utility.

The following is a non-exhaustive list of examples, which may or may not be claimed, of the subject matter according to the invention.

One example of the subject matter according to the invention relates to a tool for releasing a cable tie that comprises a head. The tool comprises a housing, an elongated member, a trigger, a first jaw, and a second jaw. The housing comprises a housing abutment surface. The elongated member is disposed at least partially within the housing. The elongated member comprises a distal end, a proximal end, and an elongated-member abutment surface. The trigger is pivotally coupled to the housing. The trigger is coupled to the elongated member and the elongated member translates along an axis when the trigger is moved relative to the housing. The first jaw abuts the housing abutment surface of the housing and is configured to engage the head of the cable tie from a first side of the head. The first jaw is located between the distal end of the elongated member and the housing abutment surface of the housing. The second jaw abuts the elongated-member abutment surface of the elongated member and is configured to engage the head of the cable tie from a second side of the head, opposite the first side. The second jaw translates relative to the first jaw along the axis when the trigger is pivoted with respect to the housing.

Use of a tool as set forth above and elsewhere herein provides for convenient, reliable removal of cable ties. For example, FOD resulting from cable tie removal may be reduced or eliminated. Use of the housing, elongated member, and trigger provide for convenient, reliable articulation of the first jaw and second jaw to remove cable ties.

Another example of the subject matter according to the invention relates to a method of using a tool to release a cable tie, fastened around an object. The tool comprises a housing, an elongated member, a trigger, a first jaw, and a second jaw. The housing has a housing abutment surface.

The elongated member is disposed at least partially within the housing and has a distal end and a proximal end. The trigger is pivotally coupled to the housing and is coupled to the proximal end of the elongated member. The first jaw abuts the housing abutment surface of the housing and is configured to engage a head of the cable tie from a first side of the head. The second jaw abuts the proximal end of the elongated member and is configured to engage the head of the cable tie from a second side of the head, opposite the first side. The method comprises positioning the tool with the first jaw proximate the second side of the head of the cable tie and with the second jaw proximate the first side of the head of the cable tie. The method also comprises contacting the second side of the cable tie with a first positioning tooth of the first jaw. Further, the method comprises, with the first positioning tooth of the first jaw contacting the second side of the head, actuating the trigger to translate the elongated member and advance a second-opening-tooth distal end of a second opening tooth of the second jaw inside an opening of the cable tie until the second-opening-tooth distal end is in contact with a contact portion of the cable tie. Additionally, the method comprises further moving the elongated member to urge the second-opening-tooth distal end of the second opening tooth of the second jaw toward the first positioning tooth of the first jaw to bias a pawl of the cable tie out of contact with teeth of the cable tie. The method also comprises removing the cable tie from the object.

Use of a method as set forth above and elsewhere herein provides for convenient, reliable removal of cable ties. For example, FOD resulting from cable tie removal may be reduced or eliminated. Use of the housing, elongated member, and trigger provide for convenient, reliable articulation of the first jaw and second jaw to remove cable ties.

BRIEF DESCRIPTION OF THE DRAWINGS

Having thus described one or more examples of the invention in general terms, reference will now be made to the accompanying drawings, which are not necessarily drawn to scale, and wherein like reference characters designate the same or similar parts throughout the several views, and wherein:

FIG. 1 is a block diagram of a tool for releasing a cable tie, according to one or more examples of the present disclosure;

FIG. 2 is a schematic, side sectional view of the tool of FIG. 1, according to one or more examples of the present disclosure;

FIG. 3 is a schematic, exploded view of aspects of the tool of FIGS. 1 and 2, according to one or more examples of the present disclosure;

FIG. 4 is a schematic, front view of orientations of an insertion portion of a jaw of the tool of FIG. 1, according to one or more examples of the present disclosure;

FIG. 5 is a schematic, sectional side view of a cable tie and the tool of FIG. 1, according to one or more examples of the present disclosure;

FIG. 6 is a block diagram of a method of utilizing the system and/or tool of FIG. 1, according to one or more examples of the present disclosure;

FIG. 7 is a block diagram of aircraft production and service methodology; and FIG. 8 is a schematic illustration of an aircraft.

DETAILED DESCRIPTION

Figure 1:
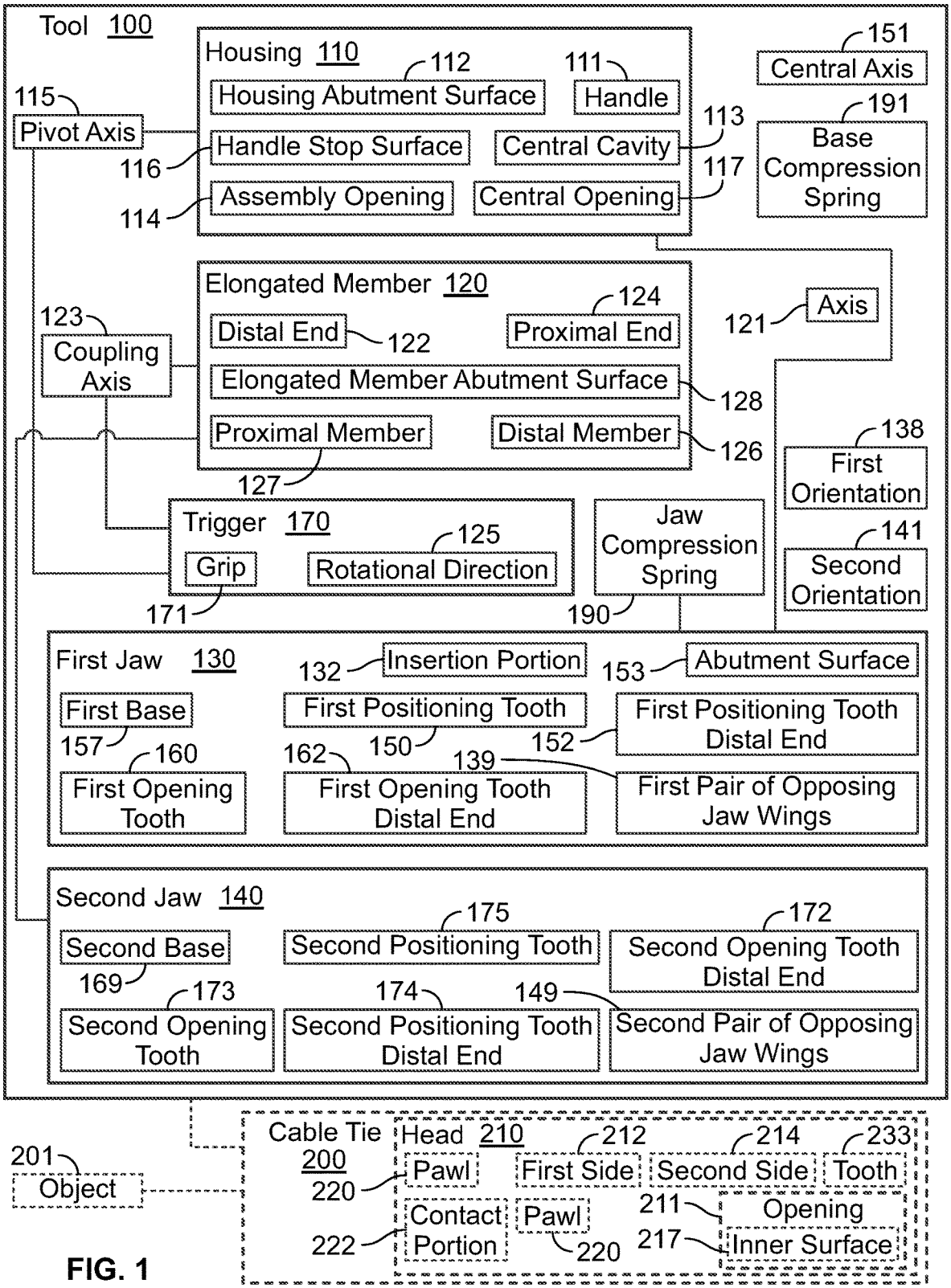

In FIG. 1, referred to above, solid lines, if any, connecting various elements and/or components may represent mechanical, electrical, fluid, optical, electromagnetic and other couplings and/or combinations thereof. As used herein, "coupled" means associated directly as well as indirectly. For example, a member A may be directly associated with a member B, or may be indirectly associated therewith, e.g., via another member C. It will be understood that not all relationships among the various disclosed elements are necessarily represented. Accordingly, couplings other than those depicted in the block diagrams may also exist. Dashed lines, if any, connecting blocks designating the various elements and/or components represent couplings similar in function and purpose to those represented by solid lines; however, couplings represented by the dashed lines may either be selectively provided or may relate to alternative examples of the present disclosure. Likewise, elements and/or components, if any, represented with dashed lines, indicate alternative examples of the present disclosure. One or more elements shown in solid and/or dashed lines may be omitted from a particular example without departing from the scope of the present disclosure. Environmental elements, if any, are represented with dotted lines. Virtual (imaginary) elements may also be shown for clarity. Those skilled in the art will appreciate that some of the features illustrated in FIG. 1 may be combined in various ways without the need to include other features described in FIG. 1, other drawing figures, and/or the accompanying disclosure, even though such combination or combinations are not explicitly illustrated herein. Similarly, additional features not limited to the examples presented, may be combined with some or all of the features shown and described herein.

Figure 6:
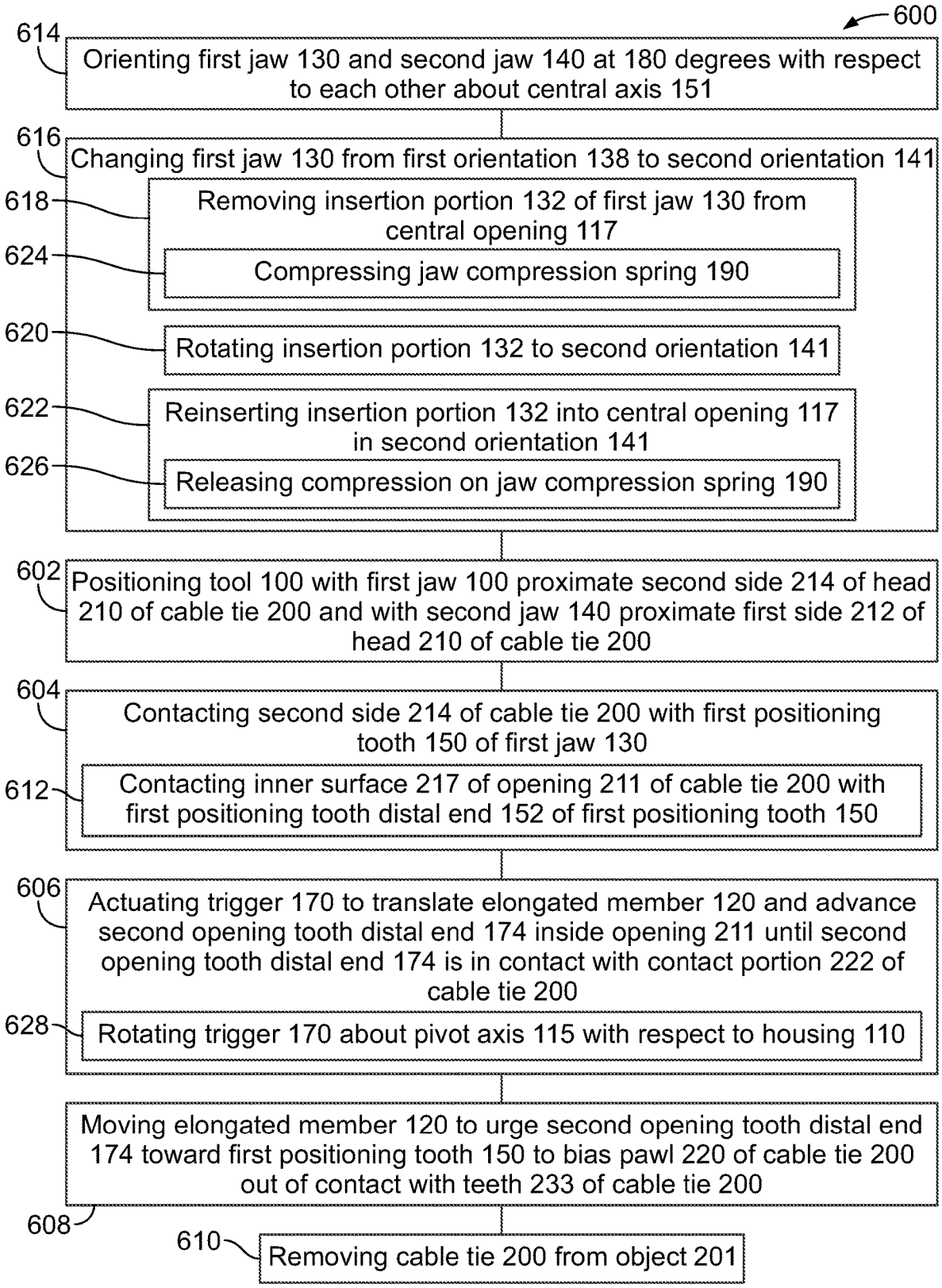
Figure 7:
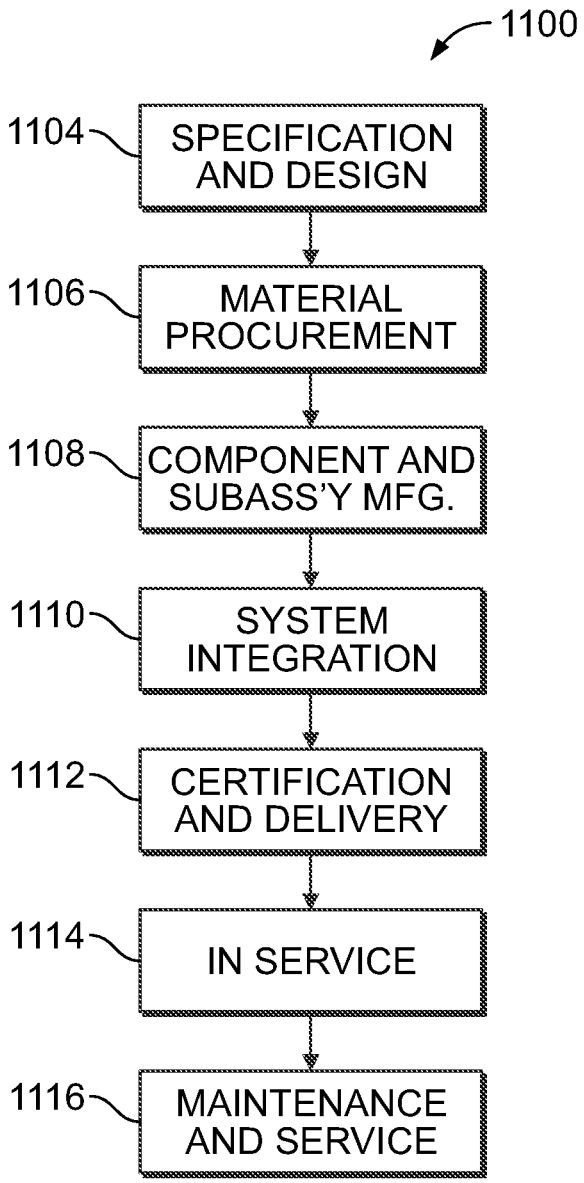

In FIGS. 6 and 7, referred to above, the blocks may represent operations and/or portions thereof and lines connecting the various blocks do not imply any particular order or dependency of the operations or portions thereof. Blocks represented by dashed lines indicate alternative operations and/or portions thereof. Dashed lines, if any, connecting the various blocks represent alternative dependencies of the operations or portions thereof. It will be understood that not all dependencies among the various disclosed operations are necessarily represented. FIGS. 6 and 7 and the accompanying disclosure describing the operations of the method(s) set forth herein should not be interpreted as necessarily determining a sequence in which the operations are to be performed. Rather, although one illustrative order is indicated, it is to be understood that the sequence of the operations may be modified when appropriate. Accordingly, certain operations may be performed in a different order or simultaneously. Additionally, those skilled in the art will appreciate that not all operations described need be performed.

In the following description, numerous specific details are set forth to provide a thorough understanding of the disclosed concepts, which may be practiced without some or all of these particulars. In other instances, details of known devices and/or processes have been omitted to avoid unnecessarily obscuring the disclosure. While some concepts will be described in conjunction with specific examples, it will be understood that these examples are not intended to be limiting.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

Reference herein to "one example" means that one or more feature, structure, or characteristic described in connection with the example is included in at least one implementation. The phrase "one example" in various places in the specification may or may not be referring to the same example.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

Illustrative, non-exhaustive examples, which may or may not be claimed, of the subject matter according the present disclosure are provided below.

Figure 2:
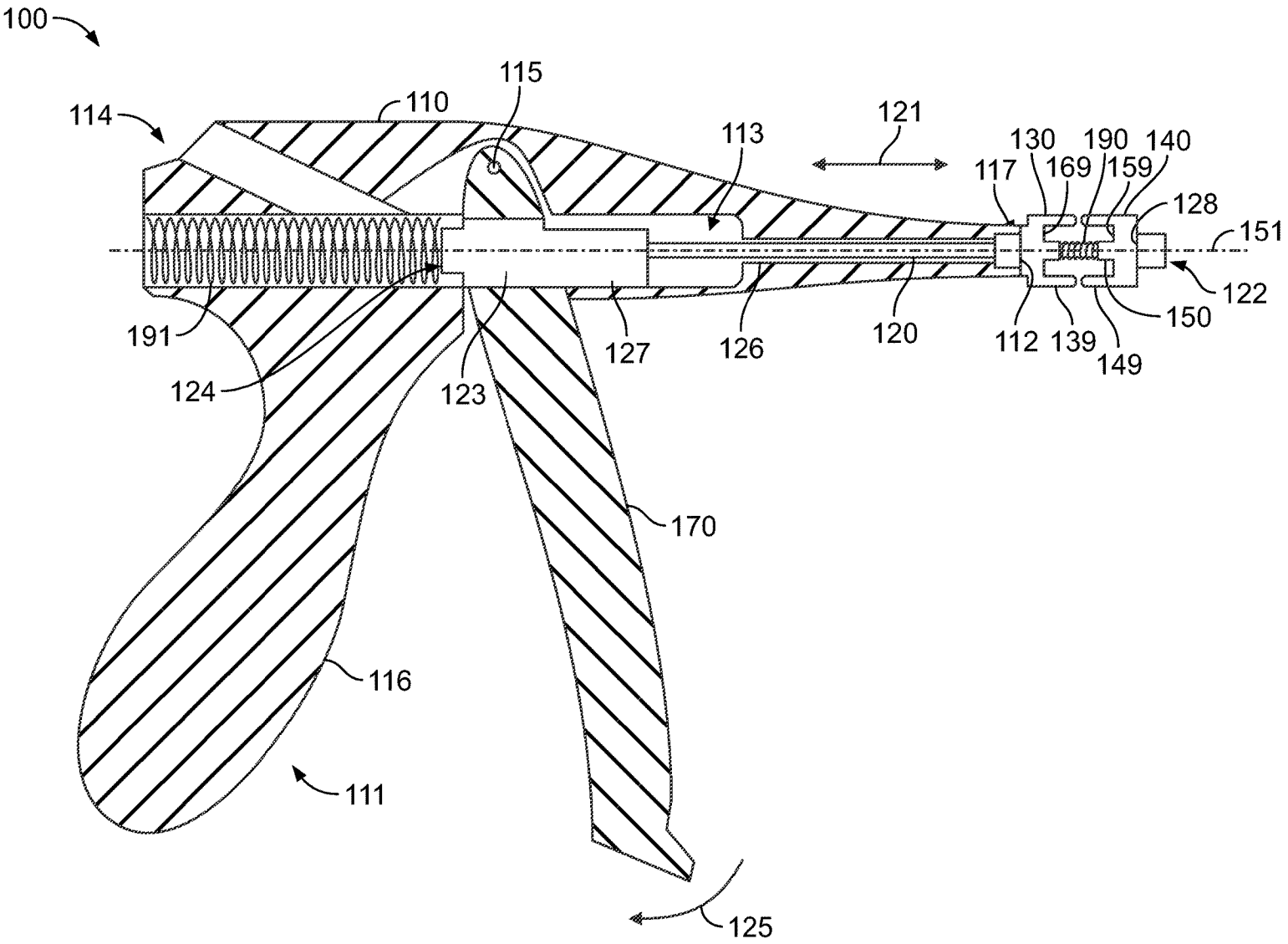
Figure 3:
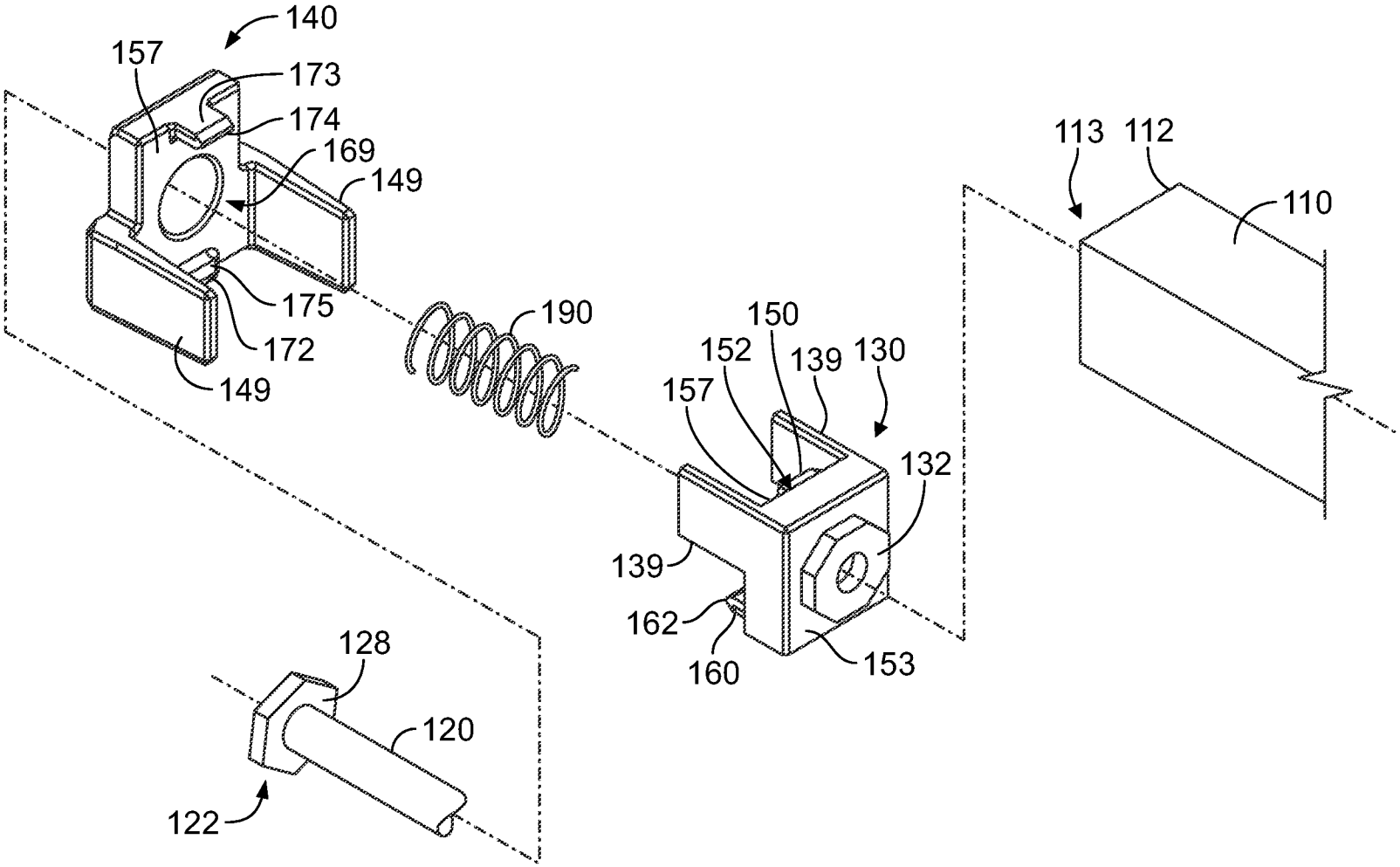
Figure 4:
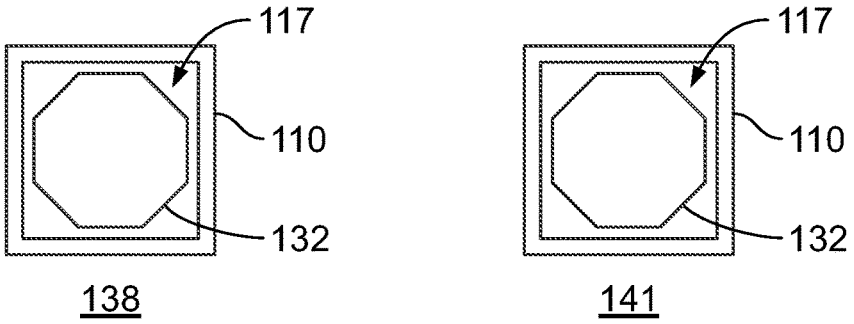

Referring generally to FIG. 1 and particularly to, e.g., FIGS. 2-4, tool for releasing cable tie 200 that comprises head 210 is disclosed. Tool 100 comprises housing 110, elongated member 120, trigger 170, first jaw 130, and second jaw 140. Housing 110 comprises housing abutment surface 112. Elongated member 120 is disposed at least partially within housing 110. Elongated member 120 comprises distal end 122, proximal end 124, and abutment surface 128. Trigger 170 is pivotally coupled to housing 110. Trigger 170 is also coupled to elongated member 120 and elongated member 120 translates along axis 121 when trigger 170 is moved relative to housing 110. First jaw 130 abuts housing abutment surface 112 of housing 110 and is configured to engage head 210 of cable tie 200 from first side 212 of head 210. First jaw 130 is located between distal end 122 of elongated member 120 and housing abutment surface 112 of housing 110. Second jaw 140 abuts elongated-member abutment surface 128 of elongated member 120 and is configured to engage head 210 of cable tie 200 from second side 214 of head 210, opposite first side 212. Second jaw 140 translates relative to first jaw 130 along axis 121 when trigger 170 is pivoted with respect to housing 110. The preceding subject matter of this paragraph characterizes example 1 of the present disclosure.

Use of a tool as set forth above and elsewhere herein provides for convenient, reliable removal of cable ties. For example, FOD resulting from cable tie removal may be reduced or eliminated. Use of the housing, elongated member, and trigger provide for convenient, reliable articulation of the first jaw and second jaw to remove cable ties.

Figure 5:
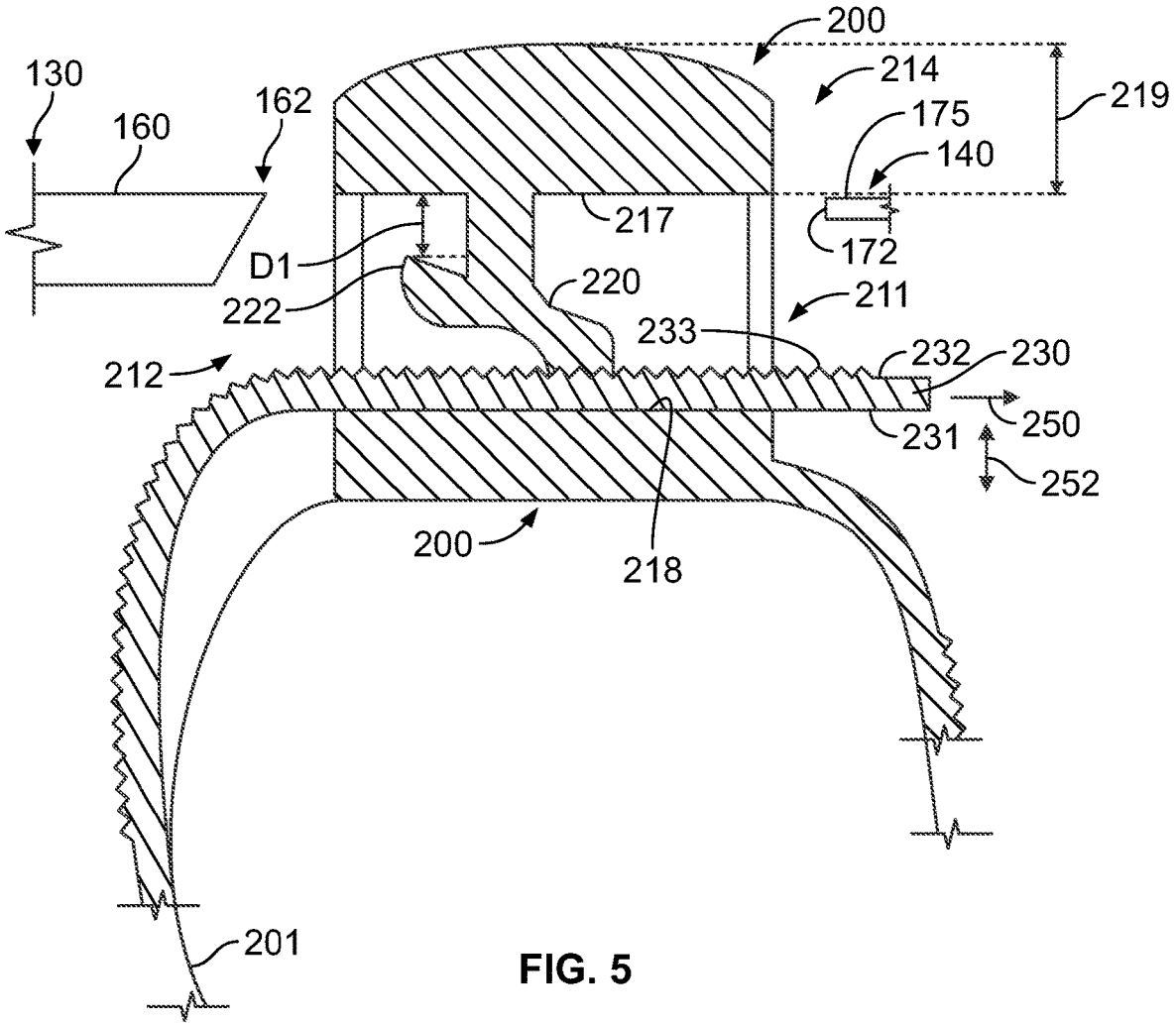

Referring generally to FIGS. 1-3 and 5, one example of the present disclosure relates to tool 100 for releasing cable tie 200. In various examples, tool 100 and/or aspects of tool 100 (e.g., first jaw 130, second jaw 140) may be configured and sized for a particular size (and/or range of sizes) and/or style of cable tie 200. Further, various aspects of tool 100 (e.g., first jaw 130, second jaw 140) may be interchangeable or replaceable with other sizes and/or designs for use with additional styles and/or sizes of cable tie 200. It may be noted the depicted examples are provided by way of illustration, and that other sizes and/or styles of cable tie 200 may be removed in various examples, with appropriate configuration of tool 100. As best seen in FIG. 5, an example of cable tie 200 includes head 210, pawl 220, and strap 230. Head 210 includes opening 211, with pawl 220 movably coupled to head 210 inside opening 211. Strap 230 includes teeth 233 extending from strap 230. Head 210 of cable tie 200 includes first side 212 and second side 214. Strap 230 is configured to be inserted through opening 211 from first side 212 to second side 214 to engage pawl 220 with teeth 233. Pawl 220 is coupled to an inner surface of opening 211, and engages teeth 233 to secure cable tie 200 in place. Tool 100 is used to remove cable tie 200 by biasing pawl 220 out of engagement with teeth 233, allowing strap 230 to be removed from head 210 and cable tie 200 to be removed from one or more objects secured with cable tie 200.

In the illustrated example, first jaw 130 (e.g., first opening-tooth distal end 162 of first opening tooth 160 of first jaw 130) of tool 100 is urged into contact with pawl 220 (e.g., by a force acting against jaw-compression spring 190 of tool 100). As first jaw 130 is further urged against pawl 220, pawl 220 biases out of engagement with teeth 233. Second jaw 140 (e.g., second-positioning-tooth distal end 172 of second positioning tooth 175) helps position and secure cable tie 200 while first jaw 130 is urged against and biases pawl 220. Once strap 230 is removed from opening 211 and cable tie 200 is removed from one or more objects, an external force may be removed, and first jaw 130 and second jaw 140 are urged away from each other to remove head 210 of cable tie 200 from tool 100 (e.g., by allowing jaw-compression spring 190 to bias first jaw 130 and second jaw 140 apart from each other a sufficient distance to remove head 210 of cable tie 200 from tool 100). It may be noted that other arrangements may be utilized. For example, first jaw 130 may be employed for positioning cable tie 200 within tool 100, and second jaw 140 used to bias pawl 220 out of engagement with teeth 233.

The particular dimensions of tool 100, including the configuration and placement of first jaw 130 and second jaw 140, may be selected or determined such that aspects of first jaw 130 and second jaw 140 not protrude far enough into opening 211 to shear or otherwise separate pawl 220 from head 210, and/or so that pawl 220 is not damaged. For example, aspects of first jaw 130 and/or second jaw 140 may be selected or designed such that pawl 220 is only biased or deflected an amount that does not shear, permanently deform, mangle, or otherwise permanently damage pawl 220 or other aspect of cable tie 200.

For example, cable tie 200 may be made of a resilient material, such that, after pawl 220 is actuated by one of first jaw 130 or second jaw 140 from an original position corresponding to engagement of pawl 220 with teeth 233 of strap 230, pawl 220 may resiliently spring back to the original position (or near to the original position if strap 230 is removed while one of first jaw 130 or second jaw 140 biases pawl 220 out of an engagement position) when first jaw 130 and/or second jaw 140 is withdrawn from opening 211 of head 210 of cable tie 200.

Aspects of tool 100 may be sized and configured so that, when tool 100 is in a closed state (e.g., with first jaw 130 and second jaw 140 brought toward each other sufficiently to bias pawl 220 out of engagement with teeth 233, pawl 220 is not actuated past a threshold or limit beyond which pawl 220 is damaged or otherwise not able to return to the original position. Thus, pawl 220 may be understood as non-destructively biased by tool 100. Thus, cable tie 200 may be re-used after being released from an object (e.g., bundle of cables or wires) using tool 100. Even if cable tie 200 is not re-used, cable tie 200 may be disposed of with pawl 220 still intact (e.g., connected to head 210), with no debris formed or separated from cable tie 200, thereby reducing or eliminating the creation of debris from the release of cable tie 200.

Pawl 220 and cable tie 200 may be made of a resilient material (e.g., a material that may be biased responsive to a force and resiliently return to an original shape or configuration when the force is removed), such as resilient plastic. Tool 100, or portions thereof (e.g., elongated member 120, first jaw 130, second jaw 140, jaw-compression spring 190) may be made of a metal or other sufficient rigid material, so that, when first jaw 130 and/or second jaw 140 is urged against pawl 220, pawl 220 biases to disengage pawl 220 from strap 230, and first jaw 130 and/or second jaw 140 do not bias or deflect, or bias or deflect a negligible amount that does not interfere with the disengagement of pawl 220 from strap 230. Portions of tool 100 (e.g., housing 110, trigger 170) may be made of a lightweight material, such as plastic, for ease of manufacture and use. For example, housing 110 and/or trigger 170 may be 3D printed, or as another example, molded. Generally, housing 110 and trigger 170 are configured to provide secure, repeatable, reliable movement or translation of elongated member to provide reliable articulation of first jaw 130 and second jaw 140 with respect to each other.

Referring generally to FIG. 1 and particularly to, e.g., FIG. 2, housing 110 comprises handle 111 and trigger 170 comprises grip 171. Trigger 170 is pivotally coupled to housing 110 about pivot axis 115. Also, trigger 170 is pivotally coupled to elongated member 120 about coupling axis 123. Second jaw 140 is translated along axis 121 toward housing abutment surface 112 of housing 110 when grip 171 of trigger 170 is pivoted along rotational direction 125 toward handle 111. The preceding subject matter of this paragraph characterizes example 2 of the present disclosure, wherein example 2 also includes the subject matter according to example 1, above.

Use of grip 171 provides convenient, controllable, and reliable movement of trigger 170 and actuation of tool 100. Pivotally coupling trigger 170 to housing 110 provides for convenient mounting as well as repeatable, reliable actuation of tool 100. It may be noted that the size of grip 171 and/or the positioning of pivot axis 115 and/or coupling axis 123 may be selected to provide a desired range of travel for elongated member 120 (and first jaw 130 and second jaw 140 relative to each other) and/or a desired amount of force (e.g., from a manual input applied via grip 171) for removal of cable tie 200. Grip 171 may be 3D printed, or as another example, molded from a plastic, and sized and shaped for convenient or comfortable use with the human hand.

Referring generally to FIG. 1 and particularly to, e.g., FIG. 2, housing 110 comprises handle stop surface 116. Trigger 170 contacts handle stop surface 116 after a predetermined travel of second jaw 140. The preceding subject matter of this paragraph characterizes example 3 of the present disclosure, wherein example 3 also includes the subject matter according to example 1 or 2, above.

Use of handle stop surface 116 helps prevent over-penetration of first jaw 130 and/or second jaw 140 into cable tie 200, and prevents shearing or other damage to pawl 220. Trigger 170 and handle stop surface 116, and/or related components, may be sized and configured so that, when tool 100 is in a closed state (e.g., with first jaw 130 and second jaw 140 brought toward each other sufficiently to bias pawl 220 out of engagement with teeth 233), pawl 220 is not actuated past a threshold or limit beyond which pawl 220 is damaged or otherwise not able to return to the original position.

Referring generally to FIG. 1 and particularly to, e.g., FIGS. 2 and 3, first jaw 130 comprises first base 157 and first positioning tooth 150, extending from first base 157 toward second jaw 140. First positioning tooth 150 comprises first-positioning-tooth distal end 152, spaced away from first base 157. Second jaw 140 comprises second base 169 and second positioning tooth 175, extending from second base 169 toward first jaw 130. Second positioning tooth 175 comprises second-positioning-tooth distal end 172, spaced away from second base 169. The preceding subject matter of this paragraph characterizes example 4 of the present disclosure, wherein example 4 also includes the subject matter according to any one of examples 1 to 3, above.

Use of positioning teeth (e.g., first positioning tooth 150 and/or second positioning tooth 175) allows for accurate positioning of tool 100 (e.g., first jaw 130 and/or second jaw 140) with respect to cable tie 200 to be removed, and/or provides secure maintenance of head 210 of cable tie 200 in a desired position while one of first jaw 130 or second jaw 140 is used to release cable tie 200 (e.g., used to bias pawl 220 out of engagement with teeth 233 of strap 230) . . . .

Referring generally to FIG. 1 and particularly to, e.g., FIGS. 2 and 3, first jaw 130 further comprises first opening tooth 160, extending from first base 157 toward second jaw 140. First opening tooth 160 comprises first-opening-tooth distal end 162, spaced away from first base 157. Second jaw 140 further comprises second opening tooth 173, extending from second base 169 toward first jaw 130. Second opening tooth 173 comprises second-opening-tooth distal end 174, spaced away from second base 169. First opening tooth 160 of first jaw 130 is located opposite second positioning tooth 175 of second jaw 140. Second opening tooth 173 of second jaw 140 is located opposite first positioning tooth 150 of first jaw 130. The preceding subject matter of this paragraph characterizes example 5 of the present disclosure, wherein example 5 also includes the subject matter according to example 4, above.

Use of opening teeth (e.g., first opening tooth 160 and/or second opening tooth 173 allows for reliable release of cable tie 200 (e.g., by cooperating with positioning teeth to allow for accurate positioning of tool 100 or aspects thereof with respect to cable tie 200 to be removed. It may be noted that, when first jaw 130 and second jaw 140 are oriented at 180 degrees to each other (e.g., first positioning tooth 150 faces toward second opening tooth 173, and second positioning tooth 175 faces toward first opening tooth 160), two different arrangements for grasping and releasing cable tie 200 are provided, thereby providing flexibility in positioning and use of tool 100 with respect to cable tie 200 (e.g., tool 100 may be used in two different positions with respect to cable tie 200).

It may be noted that different jaws with different sized opening teeth and/or positioning teeth may be interchangeably used by tool 100 to allow use with a wide range of sizes and/or styles of cable ties.

Referring generally to FIG. 1 and particularly to, e.g., FIGS. 2 and 3, first opening tooth 160 of first jaw 130 is different in size from first positioning tooth 150 of first jaw 130 and second opening tooth 173 of second jaw 140 is different in size from second positioning tooth 175 of second jaw 140. The preceding subject matter of this paragraph characterizes example 6 of the present disclosure, wherein example 6 also includes the subject matter according to example 5, above.

Use of differently sized first positioning tooth 150 and second opening tooth 173 helps match tool 100 with particular sizing or other requirements of cable ties in use to allow for accurate positioning of tool 100 or aspects thereof (e.g., first jaw 130 and second jaw 140) with respect to cable tie 200 to be removed. For example, first positioning tooth 150 may be shorter than second opening tooth 173 to allow for more spacing between first positioning tooth 150 and second opening tooth 173 with tool 100 in an open position for insertion of head 210 of cable tie 200 between first positioning tooth 150 and second opening tooth 173, while still allowing second opening tooth 173 sufficient length to effectively bias pawl 220 out of engagement with teeth 233.

Referring generally to FIG. 1 and particularly to, e.g., FIGS. 2 and 3, at least one of: first jaw 130 further comprises first pair of opposing jaw wings 139 that extend from first base 157. Second jaw 140 further comprises second pair of opposing jaw wings 149 that extend from second base 169. The preceding subject matter of this paragraph characterizes example 7 of the present disclosure, wherein example 7 also includes the subject matter according to example 5 or 6, above.

Use of first pair of opposing jaw wings 139 and second pair of opposing jaw wings 149 provides lateral support during sliding of first jaw 130 and second jaw 140 (e.g., after contact with pawl 220 to help prevent twisting) and/or provides a positive stop to prevent first jaw 130 and second jaw 140 from getting too close to each other during releasing of cable tie 200, which might remove portions from head 210 (e.g., pawl 220) of cable tie 200 resulting in debris and/or resulting in inability to re-use cable tie 200 after removal.

As seen in the illustrated example, first pair of opposing jaw wings 139 and second pair of opposing jaw wings 149 may extend from only a portion of edges of a corresponding one of first base 157 or second base 169, and be configured to overlap when first jaw 130 and second jaw 140 are urged together. It may be noted that first pair of opposing jaw wings 139 and/or second pair of opposing jaw wings 149 may be formed integrally with the corresponding base from which they extend, for example as part of a casting.

The particular size of first pair of opposing jaw wings 139 may be selected so that first jaw 130 and/or second jaw 140 sufficiently penetrates opening 211 to bias pawl 220 out of engagement with teeth 233, but is prevented from penetrating deeply enough to shear or otherwise dislodge pawl 220 (or portion thereof) from head 210 of cable tie 200. Also, the particular size of second pair of opposing jaw wings 149 may be selected so that first jaw 130 and/or second jaw 140 sufficiently penetrates opening 211 to bias pawl 220 out of engagement with teeth 233, but is prevented from penetrating deeply enough to shear or otherwise dislodge pawl 220 (or portion thereof) from head 210 of cable tie 200.

Referring generally to FIG. 1 and particularly to, e.g., FIGS. 2 and 3, first jaw 130 and second jaw 140 are oriented at 180 degrees with respect to each other about central axis 151. The preceding subject matter of this paragraph characterizes example 8 of the present disclosure, wherein example 8 also includes the subject matter according to any one of examples 1 to 7, above.

Orienting first jaw 130 and second jaw 140 at 180 degrees to each other (e.g., first positioning tooth 150 faces toward second opening tooth 173, and second positioning tooth 175 faces toward first opening tooth 160), provides two different arrangements for grasping and releasing cable tie 200 are provided, thereby providing flexibility in positioning and use of tool 100 with respect to cable tie 200 (e.g., tool 100 may be used in two different positions with respect to cable tie 200). For example, tool 100 may be placed underneath cable tie 200 or above cable tie 200. As another example, tool 100 may be advanced from a first direction to cable tie 200, or advanced from a second, opposite direction to cable tie 200.

Referring generally to FIG. 1 and particularly to, e.g., FIGS. 2 and 3, housing 110 further comprises central cavity 113 that extends along central axis 151. Elongated member 120 is disposed in central cavity 113 and extends along axis 121 within central cavity 113. The preceding subject matter of this paragraph characterizes example 9 of the present disclosure, wherein example 9 also includes the subject matter according to any one of examples 1 to 8, above.

Disposing elongated member 120 in central cavity 113 extending along axis 121 provides for reliable positioning and movement of elongated member 120 (and, accordingly, movement of first jaw 130 and second jaw 140 with respect to each other.

It may be noted that central cavity 113 may be formed within housing 110 as part of a 3D printing process, or, as another example, as part of a molding process.

Referring generally to FIG. 1 and particularly to, e.g., FIGS. 2 and 3, housing 110 further comprises assembly opening 114. Elongated member 120 further comprises proximal member 127 and distal member 126. Proximal member 127 of elongated member 120 is configured to be inserted into housing 110 via assembly opening 114. Distal member 126 of elongated member 120 is configured to be inserted into housing 110 via central cavity 113. The preceding subject matter of this paragraph characterizes example 10 of the present disclosure, wherein example 10 also includes the subject matter according to example 9, above.

Use of assembly opening 114 provides for convenient access to the interior of housing 110 (e.g., central cavity 113) for placement and securement of components such as elongated member. Use of proximal member 127 and distal member 126 allows for use of differently sized portions of elongated member 120 to help maintain elongated member 120 within central cavity 113 during assembly and use.

In the illustrated example, assembly opening 114 is at an oblique angle to central cavity 113 and central axis 151. Proximal member 127 is inserted through assembly opening 114 at the oblique angle (from the left as seen in FIG. 2), and then adjusted to be aligned with central axis 151. After alignment with central axis 151, proximal member 127 is secured (e.g., via a threaded connection) to distal member 126, which is inserted via central cavity 113 (from the right as seen in FIG. 2.) It may be noted that assembly opening 114 may be formed as part of a 3D printing process or, as another example, as part of a molding process forming housing 110.

Referring generally to FIG. 1 and particularly to, e.g., FIG. 2, tool 100 further comprises base compression spring 191, which is disposed in central cavity 113 and configured to urge distal end 122 of elongated member 120 away from first jaw 130. The preceding subject matter of this paragraph characterizes example 11 of the present disclosure, wherein example 11 also includes the subject matter according to example 9 or 10, above.

Use of base compression spring 191 helps return tool 100 to an open position (e.g., first jaw 130 and second jaw 140 separated a sufficient distance for placement of first jaw 130 and second jaw 140 on opposite sides of the exterior of cable tie 200).

In the example illustrated in FIG. 2, base compression spring 191 abuts an interior wall of housing 110 and proximal member 127 of elongated member 120. Proximal member 127 is interposed between distal member 126 and base compression spring 191. During assembly, base compression spring 191 may be inserted into housing 110 via assembly opening 114.

Referring generally to FIG. 1 and particularly to, e.g., FIGS. 2-4, central cavity 113 terminates in central opening 117. Central opening 117 is configured to accept insertion portion 132 of first jaw 130. The preceding subject matter of this paragraph characterizes example 12 of the present disclosure, wherein example 12 also includes the subject matter according to any one of examples 9 to 11, above.

Use of central opening 117 and insertion portion 132 provides for reliable placement and securement of first jaw 130 to housing 110.

It may be noted that the shape of central opening 117 and insertion portion 132 may be identical (e.g., both having a square shape) or different. Generally, central opening 117 and insertion portion 132 are sized and shaped to cooperate with each other and prevent first jaw 130 from rotating with respect to housing 110 when tool 100 is used to remove cable tie 200.

Referring generally to FIG. 1 and particularly to, e.g., FIGS. 2-4, central opening 117 and insertion portion 132 of first jaw 130 are sized and configured for insertion portion 132 to be alternatively positioned in first orientation 138 within central opening 117 and second orientation 141 within central opening 117. The preceding subject matter of this paragraph characterizes example 13 of the present disclosure, wherein example 13 also includes the subject matter according to example 12, above.

Use of different orientations allows for flexibility and adjustability of tool 100, allowing for different angles and/or directions of approach to cable tie 200, and allowing tool 100 to access cable tie 200 from different orientations (e.g., based on any obstructions near cable tie 200).

Referring generally to FIG. 1 and particularly to, e.g., FIGS. 2-4, central opening 117 of housing 110 is configured as a square-shaped opening and insertion portion 132 of first jaw 130 has an octagonal shape. The preceding subject matter of this paragraph characterizes example 14 of the present disclosure, wherein example 14 also includes the subject matter according to example 13, above.

Use of a square-shaped opening for central opening 117 and insertion portion 132 having an octagonal shape provides secure placement of insertion portion 132 within central opening 117 while also providing a variety of available orientations of first jaw 130 with respect to housing 110. Use of a square-shaped opening for central opening provides for convenient and relatively simple manufacturing of housing 110 (e.g., via molding or 3D printing).

Depending on which side of insertion portion 132 that is octagonally shaped abuts a particular side of square-shaped central opening 117, eight different orientations of first jaw 130 with respect to housing 110 are available, allowing for adjustment of first jaw 130 in increments of 45 degrees with respect to housing 110.

Referring generally to FIG. 1 and particularly to, e.g., FIGS. 2-4, first jaw 130 comprises abutment surface 153, which is configured to contact housing abutment surface 112 of housing 110 when insertion portion 132 of first jaw 130 is inserted into central opening 117. The preceding subject matter of this paragraph characterizes example 15 of the present disclosure, wherein example 15 also includes the subject matter according to any one of examples 12 to 14, above.

Use of abutment surface 153 in cooperation with housing abutment surface 112 provides for reliable, accurate positioning of first jaw 130 during operation of tool 100.

Referring generally to FIG. 1 and particularly to, e.g., FIGS. 2-3, tool 100 further comprises jaw-compression spring 190, which is disposed between first jaw 130 and second jaw 140. Jaw-compression spring 190 is disposed about elongated member 120 and is configured to urge first jaw 130 and second jaw 140 away from each other. The preceding subject matter of this paragraph characterizes example 16 of the present disclosure, wherein example 16 also includes the subject matter according to any one of examples 1 to 15, above.

Use of jaw-compression spring 190 provides an initial position (e.g., when jaw-compression spring 190 is not acted against) that maintains first jaw 130 and second jaw 140 in a position that allows placement of first jaw 130 and second jaw 140 around cable tie 200 to be removed. Jaw-compression spring 190 may also be used to urge first jaw 130 against housing 110 and helps maintain first jaw 130 in a desired position during use of tool 100.

Referring generally to FIG. 1 and particularly to, e.g., FIGS. 2-3, jaw-compression spring 190 biases first jaw 130 against housing abutment surface 112 of housing 110 and second jaw 140 against elongated-member abutment surface 128 of elongated member 120. The preceding subject matter of this paragraph characterizes example 17 of the present disclosure, wherein example 17 also includes the subject matter according to example 16, above.

Use of jaw-compression spring 190 to bias first jaw 130 against housing abutment surface 112 and second jaw 140 against elongated-member abutment surface 128 provides support for positioning first jaw 130 and second jaw 140, for maintaining first jaw 130 in contact with housing 110 during movement of tool 100 and/or removal of cable tie 200, and ma.

Referring generally to FIG. 1 and particularly to, e.g., FIGS. 2-6, method 600 of using tool 100 to release cable tie 200 fastened around object 201 is disclosed. Tool 100 comprises housing 110, elongated member 120, trigger 170, first jaw 130, and second jaw 140. Housing 110 has housing abutment surface 112. Elongated member 120 is disposed at least partially within housing 110 and has distal end 122 and proximal end 124. Trigger 170 is pivotally coupled to housing 110 and is coupled to proximal end 124 of elongated member 120. First jaw 130 abuts housing abutment surface 112 of housing 110 and is configured to engage head 210 of cable tie 200 from first side 212 of head 210. Second jaw 140 abuts proximal end 124 of elongated member 120 and is configured to engage head 210 of cable tie 200 from second side 214 of head 210, opposite first side 212. Method 600 comprises (block 602) positioning tool 100 with first jaw 130 proximate second side 214 of head 210 of cable tie 200 and with second jaw 140 proximate first side 212 of head 210 of cable tie 200. Method 600 also comprises (block 604) contacting second side 214 of cable tie 200 with first positioning tooth 150 of first jaw 130. Further, method 600 comprises (block 606), with first positioning tooth 150 of first jaw 130 contacting second side 214 of head 210, actuating trigger 170 to translate elongated member 120 and to advance second-opening-tooth distal end 174 of second opening tooth 173 of second jaw 140 inside opening 211 of cable tie 200 until second-opening-tooth distal end 174 is in contact with contact portion 222 of cable tie 200. Method 600 comprises (block 608) further comprises moving elongated member 120 to urge second-opening-tooth distal end 174 of second opening tooth 173 of second jaw 140 toward first positioning tooth 150 of first jaw 130 to bias pawl 220 of cable tie 200 out of contact with teeth 233 of cable tie 200. Method 600 also comprises (block 610) removing cable tie 200 from object 201. The preceding subject matter of this paragraph characterizes example 18 of the present disclosure.

Use of method 600 as set forth above and elsewhere herein (e.g., in connection with tool 100) provides for convenient, reliable removal of cable ties (e.g., cable tie 200). For example, FOD resulting from cable tie removal may be reduced or eliminated. Use of housing 110, elongated member 120, and trigger 170 provide for convenient, reliable articulation of first jaw 130 and second jaw 140 to remove cable tie 200. It may be noted that, additionally or alternatively, second jaw 140 may be used for positioning cable tie 200 with respect to tool 100 and first jaw 130 used for biasing pawl 220 out of contact with teeth 233 of cable tie 200.

Referring generally to FIG. 1 and particularly to, e.g., FIGS. 2-6, according to method 600, contacting second side 214 of head 210 of cable tie 200 comprises (block 612) contacting inner surface 217 of opening 211 of cable tie 200 with first-positioning-tooth distal end 152 of first positioning tooth 150 of first jaw 130. The preceding subject matter of this paragraph characterizes example 19 of the present disclosure, wherein example 19 also includes the subject matter according to example 18, above.

Contacting inner surface 217 with first-positioning-tooth distal end 152 improves stability of removal of cable tie 200. First positioning tooth 150 helps maintain cable tie 200 in place with respect to tool 100 while second opening tooth 173 of second jaw 140 is advanced into opening 211 to bias pawl 220 out of engagement with teeth 233 of cable tie 200. The particular sizing and/or shaping of first positioning tooth 150 may be selected to accommodate a particular size and/or shape of cable tie 200 (or group or range of cable ties) to be removed with tool 100.

Referring generally to FIG. 1 and particularly to, e.g., FIGS. 2-6, according to method 600, first jaw 130 and second jaw 140 are identical to each other. The preceding subject matter of this paragraph characterizes example 20 of the present disclosure, wherein example 20 also includes the subject matter according to example 18 or 19, above.

Use of first jaw 130 and second jaw 140 that are identical to each other helps save production costs and inventory costs. Use of first jaw 130 and second jaw 140 that are identical to each other also simplifies assembly, as there is no need to search for or distinguish between first jaw 130 and second jaw 140. It may be noted that, while identical to each other, first jaw 130 and second jaw 140 may be oriented differently, such that complementary portions, instead of identical portions, of first jaw 130 and second jaw 140 face each other during use of tool 100 (e.g., first opening tooth 160 of first jaw 130 and second positioning tooth 175 of second jaw 140 facing each other for use on opposite sides of cable tie 200).

Referring generally to FIG. 1 and particularly to, e.g., FIGS. 2-6, method 600 further comprises (block 614) orienting first jaw 130 and second jaw 140 at 180 degrees with respect to each other about central axis 151. The preceding subject matter of this paragraph characterizes example 21 of the present disclosure, wherein example 21 also includes the subject matter according to example 20, above.

Orienting first jaw 130 and second jaw 140 at 180 degrees with respect to each other about central axis 151 aligns complementary or cooperating portions of first jaw 130 and second jaw 140 for efficient, reliable removal of cable tie 200. For example, first positioning tooth 150 of first jaw 130 and second opening tooth 173 of second jaw 140 face or oppose each other when first jaw 130 and second jaw 140 are oriented at 180 degrees with respect to each other about central axis 151.

Referring generally to FIG. 1 and particularly to, e.g., FIGS. 2-6, method 600 further comprises (block 616) changing first jaw 130 from first orientation 138 with respect to housing 110 to second orientation 141 with respect to housing 110 before positioning tool 100. The preceding subject matter of this paragraph characterizes example 22 of the present disclosure, wherein example 22 also includes the subject matter according to example 21, above.

Use of different orientations allows for flexibility and adjustability of tool 100, allowing for different angles and/or directions of approach to cable tie 200, and allowing tool 100 to access cable tie 200 from different orientations (e.g., based on any obstructions near cable tie 200). For example, first orientation 138 may be employed when access to cable tie 200 is available from a first direction (e.g., from below cable tie 200), and second orientation 141 may be employed when access to cable tie 200 is available from a different, second direction (e.g., from above cable tie 200).

Referring generally to FIG. 1 and particularly to, e.g., FIGS. 2-6, according to method 600, changing first jaw 130 from first orientation 138 to second orientation 141 comprises (block 618), with first jaw 130 in first orientation 138, removing insertion portion 132 of first jaw 130 from central opening 117 of housing 110. Changing first jaw 130 from first orientation 138 to second orientation 141 also comprises (block 620) rotating insertion portion 132 of first jaw 130 to second orientation 141. Further, changing first jaw 130 from first orientation 138 to second orientation 141 comprises (block 622) re-inserting insertion portion 132 of first jaw 130 into central opening 117 of housing 110 in second orientation 141. The preceding subject matter of this paragraph characterizes example 23 of the present disclosure wherein example 23 also includes the subject matter according to example 22, above.

Use of central opening 117 and insertion portion 132 as discussed herein provides for reliable placement and securement of first jaw 130 to housing 110 while providing flexibility of use by providing for adjustment between first orientation 138 and second orientation 141 (and/or other orientations).

Referring generally to FIG. 1 and particularly to, e.g., FIGS. 2-6, according to method 600, removing insertion portion 132 of first jaw 130 from central opening 117 of housing 110 comprises (block 624) compressing jaw-compression spring 190, which is disposed between first jaw 130 and second jaw 140. Re-inserting insertion portion 132 of first jaw 130 into central opening 117 comprises (block 626) releasing compression on jaw-compression spring 190. The preceding subject matter of this paragraph characterizes example 24 of the present disclosure, wherein example 24 also includes the subject matter according to example 23, above.

Use of jaw-compression spring 190 in the placement and securement of insertion portion 132 provides for secure positioning of insertion portion 132 in central opening 117 of housing while allowing for replacement and/or adjustment to a different orientation of first jaw 130. Jaw-compression spring 190 may be sized and shaped to provide sufficient force to maintain insertion portion 132 of first jaw 130 in central opening 117 of housing 110 during use of tool 100 to remove cable tie 200, while providing a small enough force to be conveniently compressed by an operator during re-orientation or replacement of first jaw 130.

Referring generally to FIG. 1 and particularly to, e.g., FIGS. 2-6, according to method 600, actuating trigger 170 comprises (block 628) rotating trigger 170 about pivot axis 115 with respect to housing 110 to translate elongated member 120 along axis 121, and first jaw 130 and second jaw 140 are urged toward each other along axis 121. The preceding subject matter of this paragraph characterizes example 25 of the present disclosure, wherein example 25 also includes the subject matter according to any one of examples 18 to 24, above.

Rotation of trigger 170 about pivot axis 115 to translate elongated member 120 along axis 121 to urge first jaw 130 and second jaw 140 toward each other provides convenient reliable actuation of tool 100 for removal of cable tie 200. An operator may grasp tool 100 via handle 111 and trigger 170, and urge trigger 170 towards handle 116 to actuate tool 100 and remove cable tie 200.

Referring generally to FIG. 1 and particularly to, e.g., FIGS. 2-6, method 600 further comprises retaining cable tie 200 with tool 100 after removal of cable tie 200 from object 201. Method 600 also comprises depositing cable tie 200 in a waste receptacle. The preceding subject matter of this paragraph characterizes example 26 of the present disclosure, wherein example 26 also includes the subject matter according to any one of examples 18 to 25, above.

Retaining cable tie 200 with tool 100 after removal helps to prevent the generation of debris (FOD) in an airframe or other environment in which tool 100 is used to remove cable 200. It may be noted that cable tie 200 may be deposited directly into a waste receptacle from tool 100, or may be deposited indirectly (e.g., placed in an operator's hand from tool 100 and then discarded). To retain cable tie 200 in tool 100, trigger 170 may be maintained in an actuated position (e.g., urged toward handle 116) after removal, with trigger 170 released (e.g., via reduction or elimination of force urging trigger 170 toward handle 116) to release cable tie 200 from tool 100.

Figure 8:
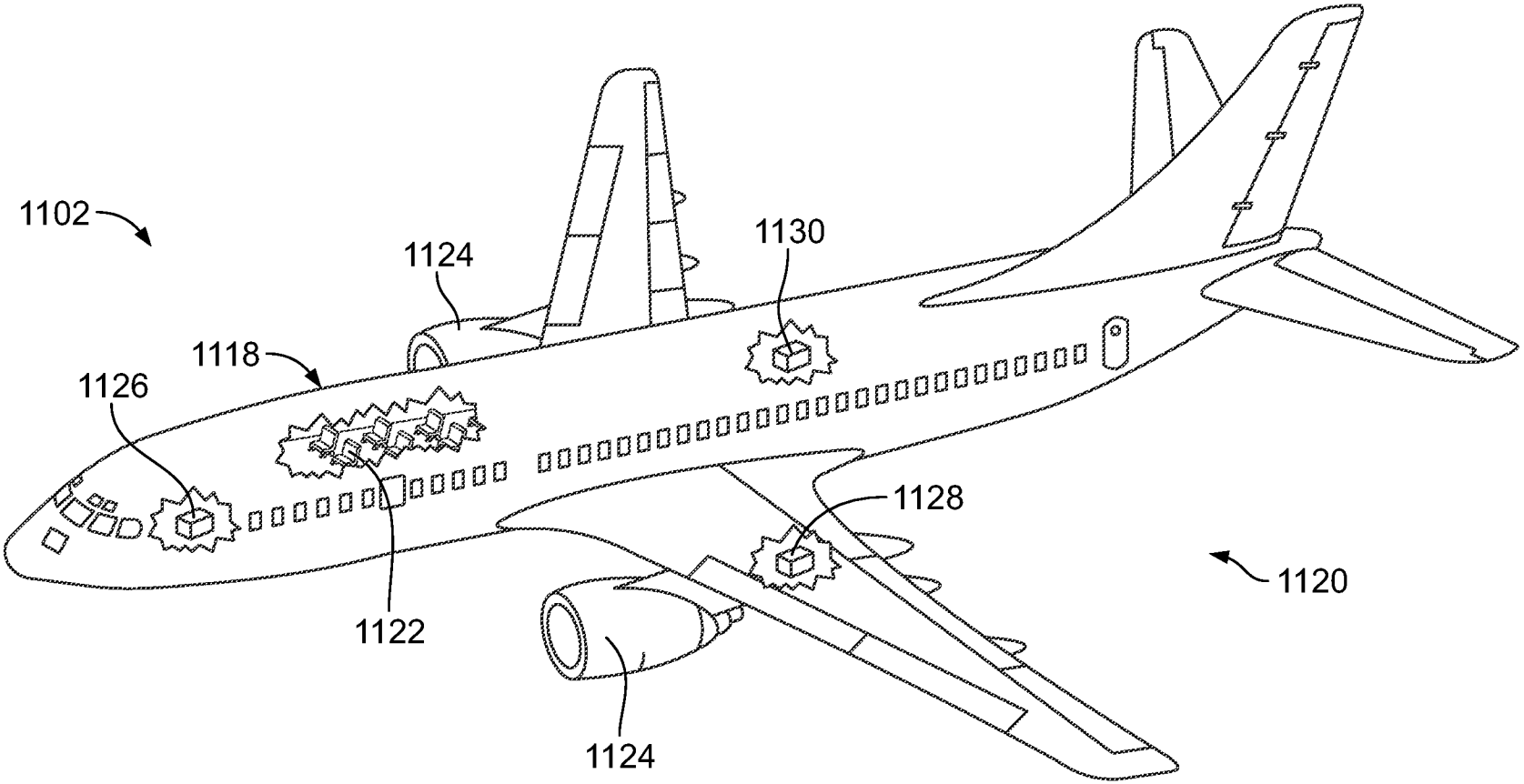

Examples of the present disclosure may be described in the context of aircraft manufacturing and service method 1100 as shown in FIG. 7 and aircraft 1102 as shown in FIG. 8. During pre-production, illustrative method 1100 may include specification and design (block 1104) of aircraft 1102 and material procurement (block 1106). During production, component and subassembly manufacturing (block 1108) and system integration (block 1110) of aircraft 1102 may take place. Thereafter, aircraft 1102 may go through certification and delivery (block 1112) to be placed in service (block 1114). While in service, aircraft 1102 may be scheduled for routine maintenance and service (block 1116). Routine maintenance and service may include modification, reconfiguration, refurbishment, etc. of one or more systems of aircraft 1102.

Each of the processes of illustrative method 1100 may be performed or carried out by a system integrator, a third party, and/or an operator (e.g., a customer). For the purposes of this description, a system integrator may include, without limitation, any number of aircraft manufacturers and major-system subcontractors; a third party may include, without limitation, any number of vendors, subcontractors, and suppliers; and an operator may be an airline, leasing company, military entity, service organization, and so on.

As shown in FIG. 8, aircraft 1102 produced by illustrative method 1100 may include airframe 1118 with a plurality of high-level systems 1120 and interior 1122. Examples of high-level systems 1120 include one or more of propulsion system 1124, electrical system 1126, hydraulic system 1128, and environmental system 1130. Any number of other systems may be included. Although an aerospace example is shown, the principles disclosed herein may be applied to other industries, such as the automotive industry. Accordingly, in addition to aircraft 1102, the principles disclosed herein may apply to other vehicles, e.g., land vehicles, marine vehicles, space vehicles, etc.

Apparatus(es) and method(s) shown or described herein may be employed during any one or more of the stages of the manufacturing and service method 1100. For example, components or subassemblies corresponding to component and subassembly manufacturing (block 1108) may be fabricated or manufactured in a manner similar to components or subassemblies produced while aircraft 1102 is in service (block 1114). Also, one or more examples of the apparatus(es), method(s), or combination thereof may be utilized during production stages 1108 and 1110, for example, by substantially expediting assembly of or reducing the cost of aircraft 1102. Similarly, one or more examples of the apparatus or method realizations, or a combination thereof, may be utilized, for example and without limitation, while aircraft 1102 is in service (block 1114) and/or during maintenance and service (block 1116).

Different examples of the apparatus(es) and method(s) disclosed herein include a variety of components, features, and functionalities. It should be understood that the various examples of the apparatus(es) and method(s) disclosed herein may include any of the components, features, and functionalities of any of the other examples of the apparatus(es) and method(s) disclosed herein in any combination, and all of such possibilities are intended to be within the scope of the present disclosure.

Many modifications of examples set forth herein will come to mind to one skilled in the art to which the present disclosure pertains having the benefit of the teachings presented in the foregoing descriptions and the associated drawings.

Therefore, it is to be understood that the present disclosure is not to be limited to the specific examples illustrated and that modifications and other examples are intended to be included within the scope of the appended claims. Moreover, although the foregoing description and the associated drawings describe examples of the present disclosure in the context of certain illustrative combinations of elements and/or functions, it should be appreciated that different combinations of elements and/or functions may be provided by alternative implementations without departing from the scope of the appended claims. Accordingly, parenthetical reference numerals in the appended claims are presented for illustrative purposes only and are not intended to limit the scope of the claimed subject matter to the specific examples provided in the present disclosure.

What is claimed is:

1. A tool for releasing a cable tie that comprises a head, the tool comprising:

a housing, comprising a housing abutment surface;

an elongated member, at least a portion of which is located within the housing, and which comprises a distal end, a proximal end, and an elongated-member abutment surface;

a trigger, pivotally coupled to the housing and coupled to the elongated member so that the elongated member-translates along an axiswhen the trigger is moved relative to the housing;

a fixed jaw, abutting the housing abutment surface of the housing, configured to engage the head of the cable tie from a first side of the head, and located between the distal end of the elongated member and the housing abutment surface of the housing so that the elongated member passes through the fixed jaw; and a movable jaw, abutting the elongated-member abutment surface of the elongated member and configured to engage the head of the cable tie from a second side of the head, opposite the first side; and wherein the movable jaw translates relative to the fixed jaw along the axis when the trigger is pivoted with respect to the housing; and the fixed jaw and the movable jaw are identical to each other, are located opposite each other along a central axis that passes along the elongated member and through the movable jaw and the fixed jaw, and are rotated 180 degrees with respect to each other about the central axis.

2. The tool of claim 1, wherein:

the housing comprises a handle;

the trigger comprises a grip;

the trigger is pivotally coupled to the housing about a pivot axis;

the trigger is pivotally coupled to the elongated member about a coupling axis; and the movable jaw is translated along the axis toward the housing abutment surface of the housing when the grip of the trigger is pivoted along a rotational direction toward the handle.

3. The tool according to claim 2, wherein:

the housing comprises a handle stop surface; and the trigger contacts the handle stop surface after a predetermined travel of the movable jaw.

4. The tool according to claim 1, wherein:

the fixed jaw comprises a first base and a first positioning tooth, extending from the first base toward the movable jaw;

the first positioning tooth comprises a first-positioning-tooth distal end, spaced away from the first base;

the movable jaw comprises a second base and a second positioning tooth, extending from the second base toward the fixed jaw; and the second positioning tooth comprises a second-positioning-tooth distal end, spaced away from the second base; and the second positioning tooth of the movable jaw is identical to the first positioning tooth of the fixed jaw.

5. The tool according to claim 4, wherein:

the fixed jaw further comprises a first opening tooth, extending from the first base toward the movable jaw;

the first opening tooth comprises a first-opening-tooth distal end, spaced away from the first base;

the movable jaw further comprises a second opening tooth, extending from the second base toward the fixed jaw;

the second opening tooth comprises a second-opening-tooth distal end, spaced away from the second base;

the second opening tooth of the movable jawis identical to the first opening tooth of the fixed jaw;

the first opening tooth of the fixed jaw is located opposite the second positioning tooth of the movable jaw; and the second opening tooth of the movable jaw is located opposite the first positioning tooth of the fixed jaw.

6. The tool according to claim 5, wherein the first opening tooth of the fixed jaw is different in size from the first positioning tooth of the fixed jaw and the second opening tooth of the movable jaw is different in size from the second positioning tooth of the movable jaw.

7. The tool according to claim 5, wherein:

the fixed jaw further comprises a first pair of opposing jaw wings, extending from the first base; and the movable jaw further comprises a second pair of opposing jaw wings, extending from the second base.

8. The tool according to claim 1, wherein:

the housing further comprises a central cavity, extending along the central axis of the elongated member; and the elongated member is disposed in the central cavity and extends along the axis within the central cavity.

9. The tool according to claim 8, wherein:

the housing further comprises an assembly opening;

the elongated member further comprises a proximal member and a distal member;

the proximal member of the elongated member is configured to be inserted into the housing via the assembly opening ; and the distal member of the elongated member is configured to be inserted into the housing via the central cavity.

10. The tool according to claim 8, further comprising a base compression spring, disposed in the central cavity and configured to urge the distal end of the elongated member away from the fixed jaw.

11. The tool according to claim 8, wherein the central cavity terminates in a central opening, configured to accept an insertion portion of the fixed jaw.

12. The tool according to claim 11, wherein the central opening and the insertion portion of the fixed jaw are sized and configured for the insertion portion to be alternatively positioned in a first orientation within the central opening and a second orientation within the central opening.

13. The tool according to claim 11, wherein the fixed jaw comprises an abutment surface, configured to contact the housing abutment surface of the housing when the insertion portion of the fixed jaw is inserted into the central opening.

14. The tool according to claim 1, further comprising a jaw-compression spring, disposed between the fixed jaw and the movable jaw, wherein the jaw-compression spring is disposed about the elongated member and is configured to urge the fixed jaw and the movable jaw away from each other.

15. The tool according to claim 14, wherein the jaw-compression spring biases the fixed jaw against the housing abutment surface of the housing and the movable jaw against the elongated-member abutment surface of the elongated member.

16. The tool according to claim 1, wherein:

the housing comprises a grip;

the elongated-member abutment surface is located between the distal end and the proximal end of the elongated member;

the elongated-member abutment surface and the housing abutment surface face each other and the elongated-member abutment surface is movable relative to the housing abutment surface;

the movable jaw is interposed between the fixed jaw and the distal end of the elongated member; and the movable jaw translates with the elongated-member abutment surface toward the fixed jaw and toward the grip along the axis when when the trigger is pivoted with respect to the housing toward the grip.

17. A tool for releasing a cable tie that comprises a head, the tool comprising:

a housing, comprising a grip and a housing abutment surface;

an elongated member, at least a portion of which is located within the housing, and which comprises a distal end, a proximal end, and an elongated-member abutment surface between the distal end and the proximal end;

a trigger, pivotally coupled to the housing and coupled to the elongated member so that the elongated member translates along an axis when the trigger is moved relative to the housing;

a fixed jaw, abutting the housing abutment surface of the housing and configured to engage the head of the cable tie from a first side of the head, and wherein the fixed jaw is located between the distal end of the elongated member and the housing abutment surface; and a movable jaw, abutting the elongated-member abutment surface and configured to engage the head of the cable tie from a second sideof the head, opposite the first side; and wherein:

the elongated-member abutment surface and the housing abutment surface face each other;

the elongated-member abutment surface is movable relative to the housing abutment surface;

the movable jaw is interposed between the fixed jaw and the distal end of the elongated member;

the movable jaw translates with the elongated-member abutment surface toward the fixed jaw and toward the grip along the axis when the trigger is pivoted with respect to the housing toward the grip; and the fixed jaw and the movable jaw are identical to each other, are located opposite each other along a central axis that passes along the elongated member and through the movable jaw and the fixed jaw, and are rotated 180 degrees with respect to each other about the central axis.

18. A tool for releasing a cable tie that comprises a head, the tool comprising:

a housing, comprising a housing abutment surface;

an elongated membe, at least a portion of which is located within the housing, and which comprises a distal end, a proximal end, and an elongated-member abutment surface;

a trigger, pivotally coupled to the housing and coupled to the elongated member so that the elongated member translates along an axis when the trigger is moved relative to the housing;

a fixed jaw, abutting the housing abutment surface of the housing and configured to engage the head of the cable tie from a first side of the head, and a movable jaw, abutting the elongated-member abutment surface of the elongated member and configured to engage the head of the cable tie from a second side of the head, opposite the first side; and wherein:

the fixed jaw is located between the distal end of the elongated member and the housing abutment surface of the housing;

the movable jaw translates relative to the fixed jaw along the axis when the trigger is pivoted with respect to the housing; and the fixed jaw and the movable jaw are identical to each other, are located opposite each other along a central axis that passes along the elongated member and through the movable jaw and the fixed jaw, and are rotated 180 degrees with respect to each other about the central axis.

19. The tool of claim 17, wherein:

the fixed jaw comprises:

a first base;

a first positioning tooth, extending from the first base; and a first opening tooth extending from the first base;

the movable jaw comprises:

a second base;

a second positioning tooth, extending from the second base; and a second opening tooth, extending from the second base;

the first positioning tooth and the second positioning tooth are identical;

the first opening tooth and the second opening tooth are identical;

the first opening tooth is different in size from the first positioning tooth;

the second opening tooth is different in size from the second positioning tooth;

the first opening tooth of the fixed jaw is located opposite the second positioning tooth of the movable jaw; and the second opening tooth of the movable jaw is located opposite the first positioning tooth of the fixed jaw.

20. The tool of claim 18, wherein:

the fixed jaw comprises:

a first base;

a first positioning tooth, extending from the first base; and a first opening tooth, extending from the first base;

the movable jaw comprises:

a second base;

a second positioning tooth, extending from the second base; and a second opening tooth extending from the second base;

the first positioning tooth and the second positioning tooth are identical;

the first opening tooth and the second opening tooth are identical;

the first opening tooth is different in size from the first positioning tooth;

the second opening tooth is different in size from the second positioning tooth;

the first opening tooth of the fixed jaw is located opposite the second positioning tooth of the movable jaw; and the second opening tooth of the movable jaw is located opposite the first positioning tooth of the fixed jaw.

* * * * *